US006951333B2

(12) United States Patent
Gösslinghoff

(10) Patent No.: US 6,951,333 B2
(45) Date of Patent: Oct. 4, 2005

(54) METHOD AND DEVICE FOR PRODUCING STACKS FROM CONTINUOUSLY SUPPLIED, FLAT ARTICLES

(75) Inventor: Reinhard Gösslinghoff, Wetzikon (CH)

(73) Assignee: Ferag AG, Hinwil (CH)

( * ) Notice: Subject to any disclaimer, the term of this patent is extended or adjusted under 35 U.S.C. 154(b) by 196 days.

(21) Appl. No.: 10/404,067

(22) Filed: Apr. 2, 2003

(65) Prior Publication Data

US 2003/0234485 A1 Dec. 25, 2003

(30) Foreign Application Priority Data

Apr. 3, 2002 (CH) ..... 0554/02

(51) Int. Cl.[7] ..... B65H 29/38
(52) U.S. Cl. ..... 271/177
(58) Field of Search ..... 271/177; 414/788.9, 414/789.2, 789.9, 790.08, 790.07, 790.2

(56) References Cited

U.S. PATENT DOCUMENTS

| | | | | | |
|---|---|---|---|---|---|
| 2,853,298 | A | | 9/1958 | Faeber | |
| 3,236,162 | A | * | 2/1966 | Reist | 198/419.3 |
| 3,377,929 | A | * | 4/1968 | Ware et al. | 414/798.5 |
| 4,747,593 | A | | 5/1988 | Stobb | |
| 4,750,728 | A | * | 6/1988 | Keller | 271/161 |
| 4,772,003 | A | | 9/1988 | Nobuta et al. | |
| 6,120,240 | A | * | 9/2000 | Ghilardi | 414/798.9 |
| 2001/0041130 | A1 | * | 11/2001 | Baur et al. | 414/789.2 |

FOREIGN PATENT DOCUMENTS

| | | | | |
|---|---|---|---|---|
| DE | 1 055 555 | | 4/1959 | |
| GB | 2 275 261 A | | 8/1994 | |
| JP | 3-120127 | * | 5/1991 | B65H/1/14 |
| JP | 5-178458 | * | 7/1993 | B65G/47/90 |

* cited by examiner

*Primary Examiner*—Donald P. Walsh
*Assistant Examiner*—Kenneth W. Bower
(74) *Attorney, Agent, or Firm*—Lacasse & Associates, LLC

(57) ABSTRACT

For being stacked, flat articles, in particular printed products, are supplied to a feed point in an imbricated stream, in which they overlap one another and are arranged standing substantially upright. In the feed point, their leading edge is pushed against an aligning element arranged transverse to the supply direction and thereby they are redirected at right angles and arranged in a stack-like arrangement. The stack-like arrangement grows in the stacking direction into a receiving device, being laterally guided and being supported at its downstream end by a supporting element. Distanced in the stacking direction from the feed point a condensing means is provided for accelerating the articles in the stack-like arrangement towards the supporting element in such a manner, that a downstream part of the stack-like arrangement is condensed and a feed-side part is kept loose. For detaching a discrete stack from the stack-like arrangement, a separating element is utilised for splitting up the supplied imbricated stream and for pushing the loose part of the stack-like arrangement against the condensed part. Thereupon the receiving device carrying the stack is replaced with an empty receiving device and the separating element is removed. Stacking comprising supplying the articles to a loose part of a stack-like arrangement, is gentle on the articles and therefore applicable without problems for articles with little stability. For detaching a stack from the stack-like arrangement, the supply stream does not have to be interrupted.

20 Claims, 7 Drawing Sheets

METHOD AND DEVICE FOR PRODUCING STACKS FROM CONTINUOUSLY SUPPLIED, FLAT ARTICLES

FIELD OF THE INVENTION

The invention is related to a method and a device which serve for producing stacks from substantially continuously supplied, flat articles, in particular from printed products, such as, e.g., newspapers, periodicals, magazines, brochures or partial or intermediate products for newspapers, periodicals or brochures.

BACKGROUND OF THE INVENTION

It belongs to the state of the art to supply printed products, such as newspapers, periodicals, magazines, brochures or partial or intermediate products thereof to a stacking operation in a substantially upright position (principal surfaces essentially vertical), overlapping one another (imbricated formation) and in an e.g. vertical or horizontal supply direction. For being stacked, the printed products are redirected by approximately 90° into a usually practically horizontal or slightly downward sloping stacking direction wherein on redirection their spatial orientation remains unchanged such that after redirection they are arranged in a stack-like manner. In this stack-like arrangement, the printed products are oriented substantially perpendicular to the stacking direction and they are aligned with one another. They are conveyed onwards in the stacking direction perpendicular to the supply direction, usually being pushed by newly supplied printed products. A downstream end of the stack-like arrangement is supported and the printed products are arranged in such a tight manner, that they mutually stabilize one another in their upright standing position. From the downstream end of the stack-like arrangement, discrete stacks are separated or detached and conveyed away for e.g. being strapped or packed, wherein each of the discrete stacks contains a predefined number of printed products or has a predefined length.

A device for producing stacks in the manner briefly described above is disclosed, for example, in the publication U.S. Pat. No. 4,772,003.

BRIEF DESCRIPTION OF THE INVENTION

It is the objective of the present invention to create a method and a device for producing stacks from flat articles in the manner briefly described above, wherein stack production according to the invention is to allow continuous article supply and is to be able to be carried out with as little strain as possible on the articles, so that it becomes possible to stack relatively unstable articles, usually not suitable for such stacking. All the same it is to be possible to accurately align the articles in the stack-like arrangement and in the stacks produced therefrom. Furthermore, the method and the device according to the invention are to make it easily possible to process irregularities in the supplied imbricated stream, in particular gaps and dammed up articles forming heaps in the imbricated stream. The device according to the invention is to be simple and in particular it is to be easily adaptable to different formats of flat articles to be stacked.

In accordance with the method of the invention, the flat articles are supplied in a supply direction to a feed point, the articles being arranged in an imbricated stream, in which they are standing substantially upright, i.e., their principal surfaces are oriented approximately vertically. At the feed point, the leading edges of the supplied articles come upon an aligning element being arranged perpendicular to the supply direction and by the effect of the aligning element are redirected by approx. 90° and thereby arranged in a stack-like manner. The stack-like arrangement grows along the aligning element in an e.g. horizontal stacking direction, its downstream end being supported. Periodically discrete stacks are separated from this downstream end.

According to the invention, the stack-like arrangement is divided into a loose part on the feed-side and a dense part facing downstream, the division being effected by an accelerating action on the articles of the stack-like arrangement in an active zone situated at a distance downstream from the feed point, by which action the articles are accelerated towards the downstream end of the stack-like arrangement and pressed against the most downstream articles. By this action, the stack-like arrangement is condensed in the active zone and downstream of it, while between the active zone and the feeding point it is held in a loose configuration. The accelerating action is exerted on two opposite edge zones of the articles.

Articles newly supplied to the stack-like arrangement are therefore pushed into the loose part of the stack-like arrangement at the feed point, so that the feeding operation is met with a significantly lower resistance than would be the case, if all articles in the stack-like arrangement had to be displaced in stacking direction by the newly supplied articles. Furthermore, this resistance is independent of the momentary length of the stack-like arrangement. The effect is advantageously amplified by displacing the articles in the loose part of the stack-like arrangement not only by the newly supplied articles, but additionally by using suitable means for actively moving them in stacking direction. The loose article arrangement on the first part of the path in the stacking direction does not only allow practically resistance-free article supply, therewith making it applicable without problems for articles with little stability, but it also renders the alignment of the articles on the aligning element or if so required by additional aligning means more reliable (less obstruction between articles in the loose arrangement than would be the case in a dense arrangement).

When the stack-like arrangement growing in the stacking direction has reached a predefined length in stacking direction, the loose part is pushed against the dense part and the discrete stack formed in this manner is removed, while immediately a new loose part starts forming and downstream of the active zone once again a dense part is produced.

The device in accordance with the invention essentially comprises the following components: a supply means for supplying articles arranged upright and overlapping one another, an aligning element for redirecting supplied articles to form a stack-like arrangement, a means for guiding and supporting the stack-like arrangement, a separating means for pushing together the loose and the condensed part of the stack-like arrangement as well as a condensing means being situated in the active zone at a distance from the feed point and acting on opposite edges of the articles in the stack-like arrangement by accelerating them in stacking direction. For the task of detaching the stack from the stack-like arrangement, the means for guiding and supporting are advantageously designed to be displaceable and are provided in a plurality, so that together with each stack one means is detached and simultaneously a further means is positioned for a next stack.

Stack formation according to the invention as compared with conventional stack formation of the same type has the following main advantage: in the zone of the feed point, i.e. immediately prior to and after redirection by 90°, the articles act on one another with only minimal forces, so that article alignment, even for not very stable articles, is easy and accurate. The loose arrangement of the articles in the upstream part of the stack-like arrangement also makes it possible to feed the articles in a slightly bent configuration and therefore stabilized and stiffened, which further helps accurate redirection and alignment. Furthermore, the loose arrangement just downstream of the feed point makes it possible to process imbricated streams comprising thicker regions caused by dammed up articles.

BRIEF DESCRIPTION OF THE DRAWINGS

The method according to the invention and exemplary embodiments of the device in accordance with the invention are described in detail on the basis of the following Figs., wherein.

DETAILED DESCRIPTION OF THE INVENTION

Figure 1:
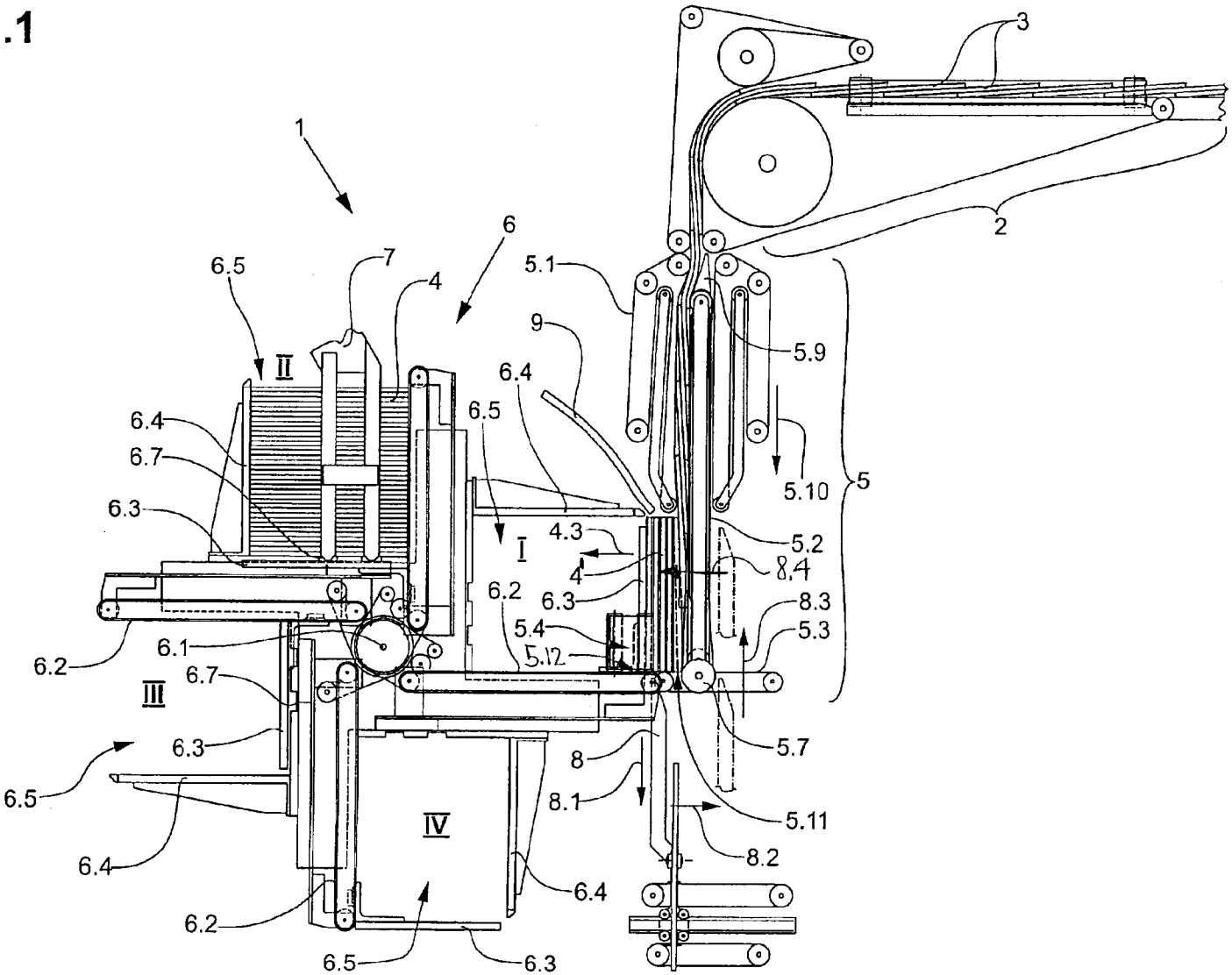
FIG. 1 shows an exemplary embodiment of the device according to the invention (viewing direction perpendicular to the supply direction and to the stacking direction)

FIG. 1 illustrates an exemplary embodiment of the device 1 in accordance with the invention. For producing stacks 4, an imbricated stream of flat articles 3, e.g. folded or bound printed products, is supplied to the device 1 by any suitable supply means 2. The device 1 substantially comprises a feed part 5 and a stacking part 6, which co-operate for the stack production operation.

The essential components of the feed part 5 are the supply means, for example supply belts 5.1 and 5.2, an aligning element 5.3, a condensing means 5.4 and a separating element 8. The supply belts 5.1 and 5.2 supply the imbricated stream in which the articles 3 are overlapping each other and are oriented substantially upright. The aligning element 5.3 is arranged transverse to the supply direction 5.10 and redirects the supplied articles from the supply direction 5.10 to the stacking direction 4.3, such aligning them and if so required also displaces them in the stacking direction 4.3. The condensing means 5.4 is arranged in an active zone 5.12 and serves to condense the downstream part of the stack-like arrangement 4'. Its function is described in more detail in conjunction with FIGS. 2 to 4. The separating element 8 serves to separate the supplied imbricated stream and for pushing the loose part of the stack-like arrangement 4' towards the condensed part.

The flat articles 3 are conveyed towards the aligning element 5.3 between the at least two endless belts 5.1, 5.2 in the supply direction 5.10. At the feed point 5.11, their leading edges meet the aligning element 5.3 extending transverse to the supply direction and serving for arranging the articles in a stack-like manner. The articles are displaced along the aligning element 5.3 in the stacking direction 4.3 (perpendicular to the supply direction 5.10), on the one hand being pushed by further supplied articles and advantageously also actively moved in this direction, for example, by the aligning element 5.3 being designed, as illustrated, as a conveyor belt driven in the stacking direction 4.3 or comprising a conveyor belt.

The stacking part 6 comprises at least two receiving devices 6.5, the essential components of which are a conveying substrate 6.2 and a supporting element 6.3. The receiving devices 6.5 serve to receive the continually growing, stack-like arrangement 4' and to remove a stack 4 from the feed part 5, after its separation from this stack-like arrangement 4'. The conveying substrate 6.2 and the supporting element 6.3, which during the reception of the stack-like arrangement 4' are both moving in the stacking direction 4.3, guide, support and convey the articles in this arrangement 4'. The conveying substrate 6.2 may also be designed as stationary support, on which the articles stand upright and push one another.

For separating discrete stacks 4 from the stack-like arrangement 4' without interruption of the supply, the stacking part 6 comprises e.g. four identical receiving devices 6.5 being arranged rotatable around a rotation axis 6.1 at a distance of 90° from one another in such a manner, that with every rotation step of 90°, a receiving device carrying a stack 4 is swivelled away from the feed part 5 and a following, empty receiving device is connected to the feed part 5.

The receiving device 6.5 designated with I in FIG. 1 is connected to the feed part 5. The stack-like arrangement 4' grows into this receiving device, wherein the supporting element 6.3 is continuously displaced in the stacking direction 4.3 and the conveying substrate 6.2 moves in the stacking direction. As soon as the supporting element 6.3 has reached its end position, i.e., the receiving device 6.5 is sufficiently full, the stacking part 6 is rotated by 90 degrees in counter-clockwise direction, by which the receiving device with the just formed stack 4 is moved into the position designated with II. The stack 4 is here supported by a supporting surface comprising grooves 6.7 for engaging arms of an ejection device 7. With the help of the ejection device 7, the stack 4 is pushed out of the receiving device 6.5. By further rotation steps of 90° each, the receiving device 6.5 is rotated into the positions designated with III and IV. In doing so, it is advantageous to couple the receiving devices 6.5 situated diagonally opposite one another in such a manner, that the supporting element 6.3 of a receiving device connected to the feed part 5 (position I) is moved from its starting position to its end position, while in the receiving device in position III the supporting element 6.3 is moved from its end position into the starting position. In the positions II and IV, the supporting element is stationary.

The separating element 8 acting between the active zone 5.12 and the feed point 5.11 also serves the separation of discrete stacks 4 from the stack-like arrangement 4'. It is designed being supported on suitable bearings for moving both in a vertical direction 8.1, 8.3 as well as in a horizontal direction 8.2, 8.4. The function of the separating element 8 is described in more detail in conjunction with FIGS. 6 to 8.

The spatial orientation of the device according to the invention as illustrated in FIG. 1 is to be selected in such a manner, that, during supply to the feed point 5.11 and in the stack-like arrangement 4', the principal surfaces of the flat articles 3 are oriented substantially vertically, i.e. parallel to gravity, and in such a manner that the stacking direction 3.4 is substantially horizontal. The rotation axis 6.1 is e.g. substantially horizontal, so that the articles 3 are standing upright on the aligning element 5.3 and on the conveying substrate 6.2 adjoining it. The axis 6.1 may also be substantially vertical, in which case the supply direction 5.10 is substantially horizontal and the stack-like arrangement 4' is lying laterally against the aligning element 5.3. This means that for the supporting and conveying function, a conveying means separate from the aligning element 5.3 has to be provided, on which the articles stand upright after being redirected and which connects to the conveying substrate 6.2. In this case it is also advantageous to provide a further, lateral guide element 6.4 for guiding the stack-like arrangement.

It is not relevant for the invention, that the at least two receiving devices 6.5 of the stacking part are capable of being rotated around an axis 6.1 perpendicular to the stacking direction 4.3, as illustrated in FIG. 1. The replacement of a full receiving device with an empty one may also be taken care of in another appropriate way.

Figure 2:
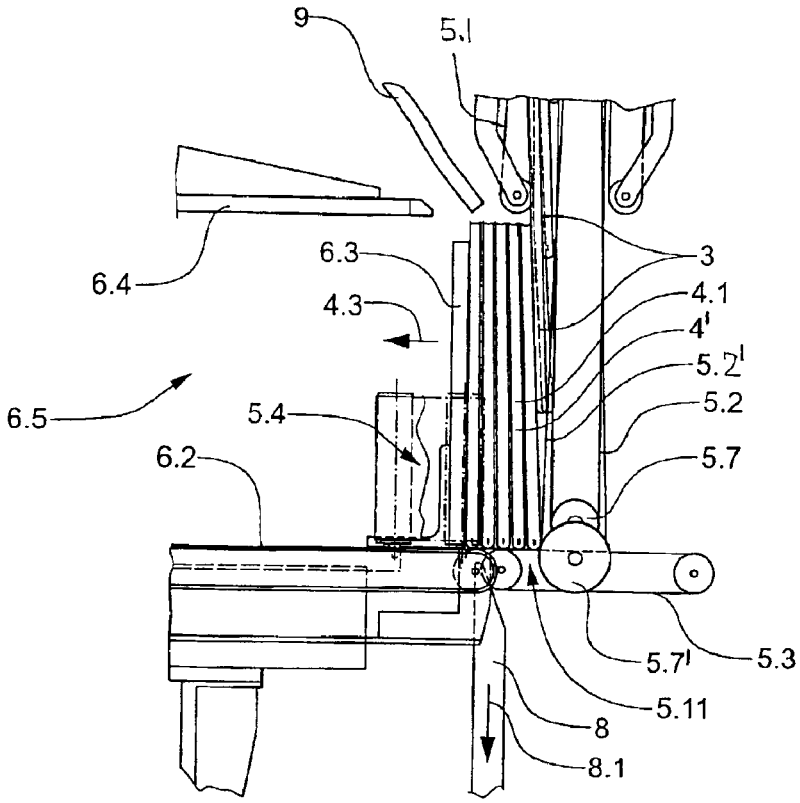
FIGS. 2 and 3 show the feeding point and active zone of the device according to FIG. 1 at two successive stages of the stack formation (viewing direction as in FIG. 1)
Figure 3:
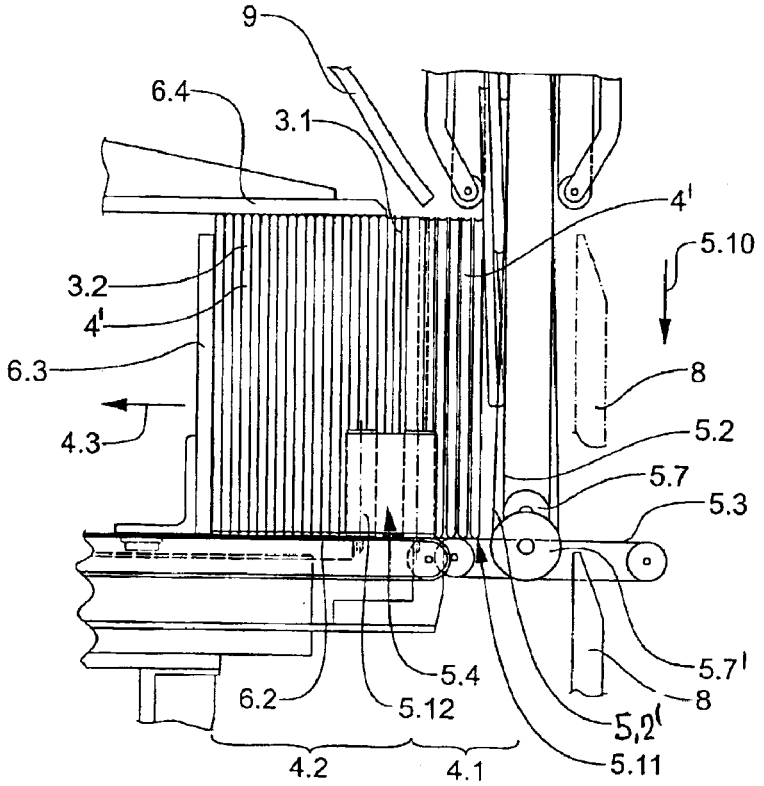
Figure 4:
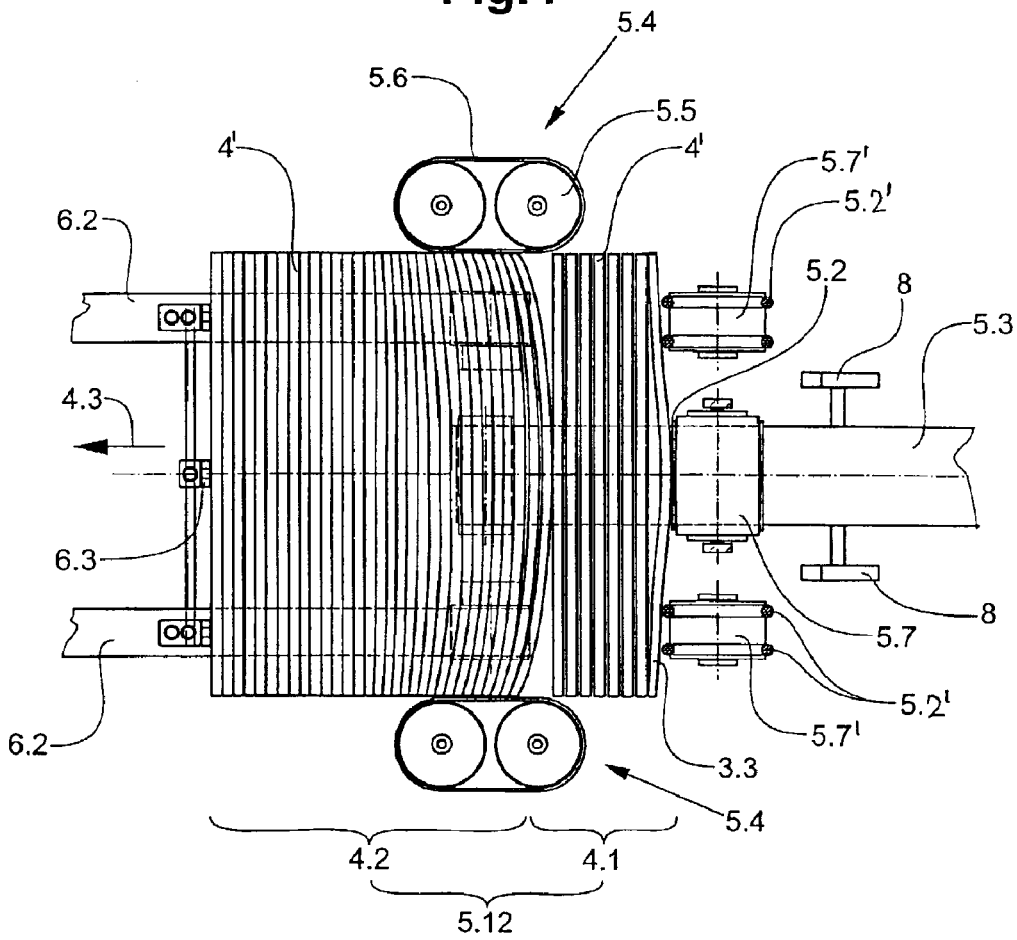
FIG. 4 show the detail in accordance with FIGS. 2 and 3 viewed parallel to the supply direction and perpendicular to the stacking direction.

The formation of the stack-like arrangement 4', which in accordance with the invention comprises an upstream loose part 4.1 and a downstream condensed part 4.2, is described in more detail on the basis of FIGS. 2 to 4. These Figs. illustrate the formation of the stack-like arrangement 4' with its upstream loose part 4.1 and downstream condensed part 4.2 in an enlarged view perpendicular to supply direction 5.10 and stacking direction 4.3 (FIGS. 2 and 3) and parallel to the supply direction (FIG. 4). Same elements are designated with the same reference numbers as in FIG. 1.

FIG. 2 illustrates an inner supply belt 5.1 and outer supply belts 5.2 (central) and 5.2' (lateral) being deflected on the feed side by deflection rollers 5.7 and 5.7'. The lateral outer belts 5.2' are arranged further inwards than the central outer belt 5.2 and the inner belt 5.1 is pressed against the central outer belt 5.2. With the help of this belt arrangement the supplied articles 3 are bent around a bending axis parallel to the supply direction 5.10 during supply in order to stabilize and stiffen them up until they meet the aligning element 5.3.

The supporting element 6.3 is illustrated in FIG. 2 in its starting position in the active zone 5.12, i.e. in a position, in which it is situated, when a stack has just been separated from the stack-like arrangement 4'. In this position it is distanced in stacking direction 4.3 from the feed point 5.11, i.e. the stack-like arrangement 4' only comprises a loose part 4.1.

While articles 3 are continuously supplied to the loose part 4.1 of the stack-like arrangement at the feed point 5.11 and are displaced in stacking direction towards the supporting element 6.3 by further supplied articles 3 and possibly by the conveyor belt of the aligning element 5.3, the supporting element 6.3 is moved away from the feed point 5.11, advantageously coupled to the conveying substrate 6.2. Advantageously, also the belt of the aligning element 5.3 is driven with the same speed, which speed is matched to the supply stream (speed and spacing between the articles) and to the thickness of the supplied articles.

In the active zone 5.12, the conveying substrate 6.2 designed e.g. as a double conveyor belt adjoins the aligning element 5.3 and guides and conveys the stack-like arrangement 4' being supported at its downstream end by the supporting element 6.3 into the receiving device 6.5.

FIG. 3 illustrates the same detail as FIG. 2 of the device according to FIG. 1 The stack-like arrangement 4' has grown further and comprises more articles 3. In the illustrated, stack-like arrangement 4' a cross stack is pre-formed; the folded (or bound) edge of the articles 3.2 is directed upwards and the folded edge of the articles 3.1 is directed downwards. For a crossed arrangement of this kind, the articles 3, 3.1, 3.2 have to be supplied in a corresponding manner.

The condensing means 5.4 is distanced in stacking direction 4.3 from the feed point 5.11 and it is arranged to act on two opposite edge zones of the articles 3 in the stack-like arrangement 4' in order to accelerate the articles in stacking direction 4.3. By this acceleration, the downstream part 4.2 of the stack-like arrangement 4' is driven towards the supporting element 6.3 and thereby condensed. The condensing means 5.4 is e.g. designed as a pair of endless belts working synchronously and in opposite directions, wherein the speed of these belts is greater than the speed of the belt of the aligning element 5.3, of the conveying substrate 6.2 and of the supporting element 6.3.

FIG. 4 illustrates the stack-like arrangement 4' of articles 3 with its condensed part 4.2 and loose part 4.1, viewed parallel to the supply direction. Of the condensing means 5.4, the deflection rollers 5.5 and the two endless belts 5.6 are visible. Effected by these, the articles are, if so required, slightly bent in the active zone 5.12. In the loose part 4.1 of the stack-like arrangement 4', i.e. between feed point 5.11 and active zone 5.12, the articles 3 are loosely arranged and only exert little force on one another. The articles 3 within the loose part 4.1 are standing upright on the aligning element 5.3 (or on a corresponding conveying means) and are displaced by it in stacking direction 4.3. Due to the mutual freedom of the articles 3 to move in this loose part 4.1 and due to the force of gravity, the articles are accurately aligned on the aligning device 5.3 (or on the corresponding conveying means).

Also visible in FIG. 4 is the bent configuration of the supplied articles 3, which has already been mentioned in connection with FIG. 2. Through this bent configuration, every article obtains an additional stability in the supply direction, which renders feeding of every article safer and more accurate. As soon as the trailing edge of an article is not any more held between the supply belts 5.1 and 5.2, the article unbends. For the bending purpose, the outer belts 5.2 and 5.2' are, as already mentioned, arranged slightly offset in stacking direction 4.3 at least in the feed point 5.11 area. This is e.g. achieved by using deflection rollers 5.7' of a greater diameter for the lateral outer supply belts 5.2' (depicted here as a pair of strings) than for the central outer supply belt 5.2. As a result of this and as evident from the lateral views of FIGS. 2 and 3, the lateral outer supply belts 5.2' do not extend exactly perpendicular to the stacking direction 4.3 as the central outer belt 5.2 does, but rather slightly inclined towards the stacking direction 4.3. By means of this arrangement of the outer supply belts 5.2 and 5.2', a supplied article 3 is bent around a bending axis parallel to the supply direction, as is depicted in FIG. 4 on the last supplied article 3.3.

Figure 5:
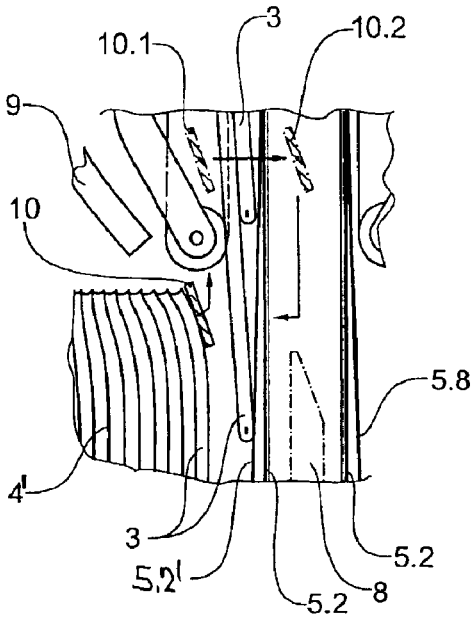
FIGS. 5 and 6 show further details of the embodiment according to FIG. 1.

FIG. 5 illustrates a retaining element 10, which, as indicated by the positions 10.1 and 10.2, is mounted to be displaceable along the path represented with arrows. The retaining element 10 is moved into its working position depicted with unbroken lines, when there is a gap in the supply stream of articles 3, i.e. when there is no overlap between two successive articles. The articles supplied before the gap are kept away from the feed point by the retaining element 10, so that there is no conflict with articles supplied after the gap. As soon as the supply is working continuously again, the retaining element 10 is moved into the position designated with 10.1, in order to in case of a further gap be moved once again via the position 10.2 into a position behind the last article before the gap.

Figure 6:
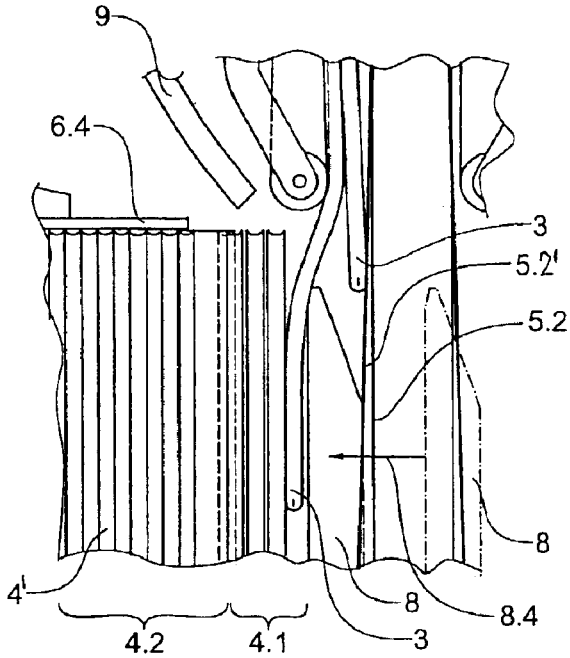

FIG. 6 illustrates in detail the operating mode of the separating element 8. The separating element 8 is depicted with dot-dash lines in a waiting position. As soon as the stack-like arrangement 4' has reached the predefined size of a stack 4, the separating element 8 is moved through the feed point (position illustrated with an unbroken line) in the direction 8.4 (stacking direction). This displacement is synchronised with the supply stream of the flat articles 3 in such a manner, that during the displacement of the separating element 8 a last article 3 is supplied to the still loose part of the stack-like arrangement 4' downstream of the separating element 8 and a following article 3 is supplied behind the separating element 8.

Figure 7:
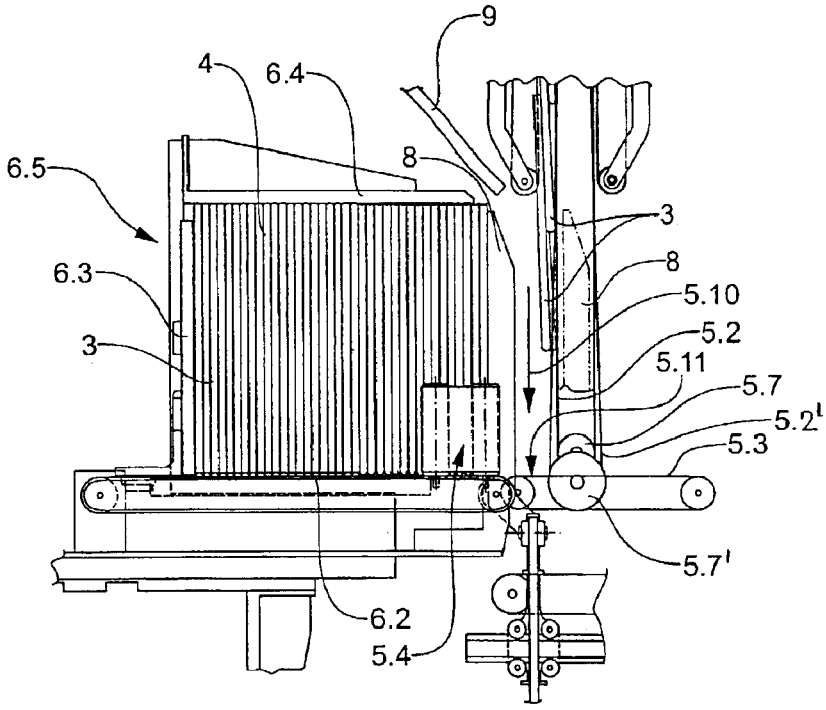
FIGS. 7 and 8 show two further details of the embodiment in accordance with FIG. 1 at two successive stages of separation and detachment of a discrete stack from the stack-like arrangement of the articles (viewed as in FIGS. 1 to 3)

FIG. 7 illustrates the separating element 8 in its end position distanced in stacking direction from the feed point 5.11 and at the beginning of the active zone, where the conveying substrate 6.2 adjoins the aligning element 5.3. By displacing the separating element 8 into this position, the loose part of the stack-like arrangement 4' is pushed against the condensed part, so that between the separating element 8 and the supporting element 6.3 a discrete, dense stack 4 is produced. Behind the separating element 8 articles 3 continue to be supplied, so that once again a loose part 4.1 of a stack-like arrangement is formed.

Quite obviously, the distance between the feed point and the end position of the separating element 8 or the starting position of the supporting element 6.3 respectively (beginning of the active zone) is to be selected in such a manner, that it is large enough to receive in a loose arrangement the articles supplied during the detachment of the stack 4, and in such a manner, that the first articles supplied after the detachment of the stack are able to maintain an upright position.

Figure 8:
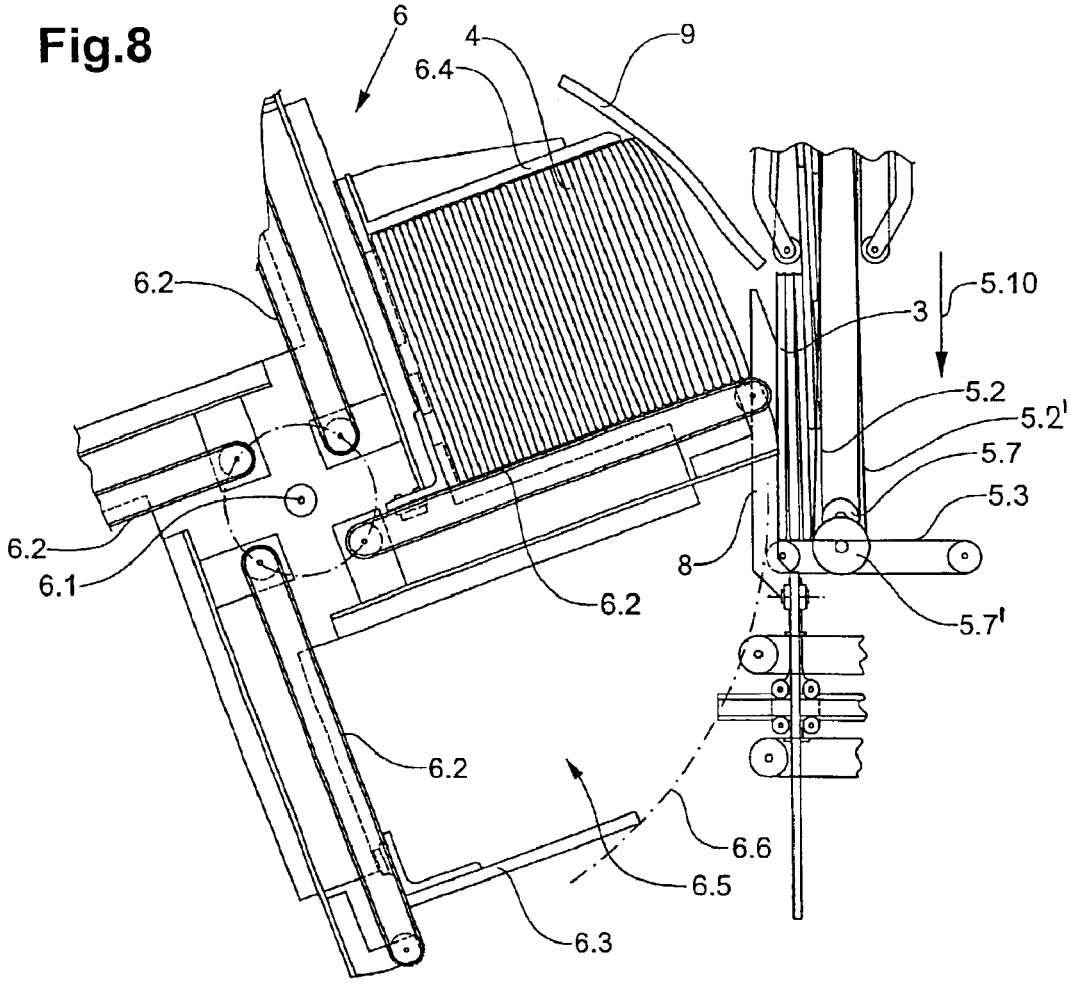

FIG. 8 depicts the rotation of the stacking part of the device in accordance with the invention in the direction 6.6, by means of which the produced stack 4 is moved away from the feed part and a further, empty receiving device 6.5 with the supporting element 6.3 in its starting position is connected to the feed part.

During rotation the separating element 8 remains in the position already illustrated in FIG. 7 and temporarily takes over the function of the supporting element supporting the articles, which continue to be supplied. The condensing means, which is not illustrated in FIG. 8, is not displaced either. During rotation, the separating element 8 guides one of the upstream edges of the stack 4. Advantageously an additional guide 9 is provided for guiding upstream edges, which guide extends the guidance provided by the separating element 8.

As soon as the further, empty receiving device is connected to the feed part, the separating element 8 is displaced in the directions 8.1, 8.2 and 8.3 (see FIG. 1) to be brought into the waiting position, which is illustrated in FIGS. 3 and 6 with dot-dash lines. From FIG. 4, which represents the separating element 8 seen from above in this waiting position, it is evident, that it comprises two parts capable of being moved through between the central outer supply belt 5.2 and the lateral outer supply belts 5.6', or between the deflection rollers 5.7 and 5.7' respectively.

Figure 9:
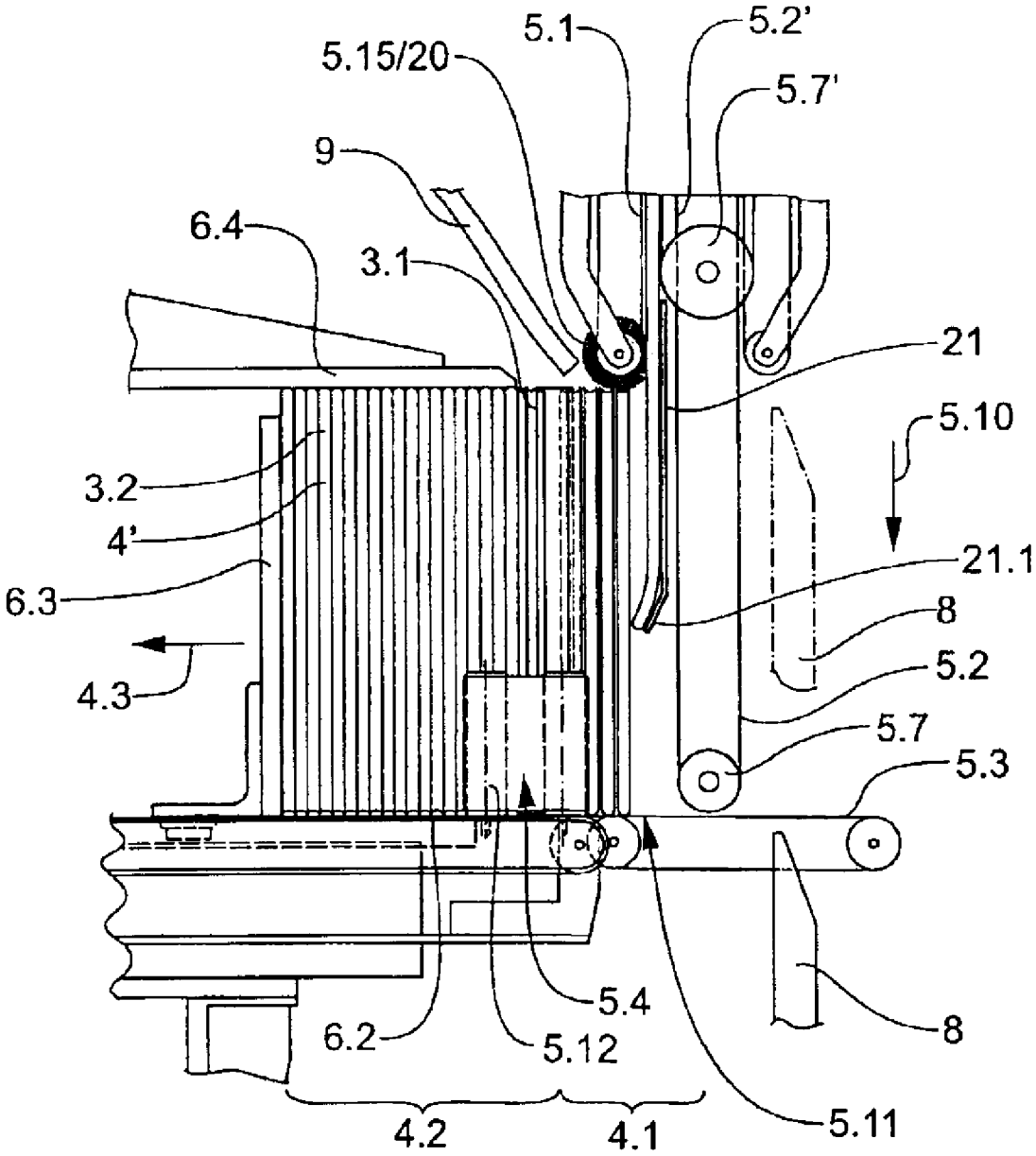
FIG. 9 shows a further, advantageous embodiment of the feed part of the device according to the invention (depicted as in FIG. 3)

FIG. 9 shows in the same way as FIG. 3 a further advantageous embodiment of the feed part of the device according to the invention. Same elements are designated with the same reference numbers. In this embodiment the feed side deflection roller 5.15 of the inner supply belt 5.1, which deflection roller is arranged just above the loose part of the stack-like arrangement 4', comprises on either side of the supply belt 5.1 a brush roller 20. These brush rollers 20 constitute a further means for driving articles which are just released from being held between inner and outer supply belt 5.1 and 5.2 in stacking direction 4.3 forward. Furthermore, the brush rollers take over the function of the retaining element 10 as shown in FIG. 5, wherein other than the retaining elements 10, the brush rollers 20 act on the articles in a continuous way, such that a gap in the supply stream does not need any specific measures to be taken nor are corresponding sensor means for activating such measures needed.

Furthermore, the feed part according to FIG. 9 comprises instead of the feed side ends of the lateral outer supply belts 5.2' as illustrated in FIG. 3, guide sheets 21 being arranged on either side of the central outer supply belt 5.2. These guide sheets comprise at there ends facing towards the aligning element 5.3 a protrusion 21.1 protruding forward in stacking direction. Leading parts of supplied articles are bent forward in stacking direction 4.3 by the protrusions 21.1, such creating even more room in the loose part of the stack-like arrangement for further supplied articles. According to the design of the guide sheets 21 the lateral outer supply belts 5.2' may be absent or they may end further away from the aligning element 5.3 where the guide sheets 21 start and are designed for bending supplied articles as shown in FIG. 4.

Figure 10:
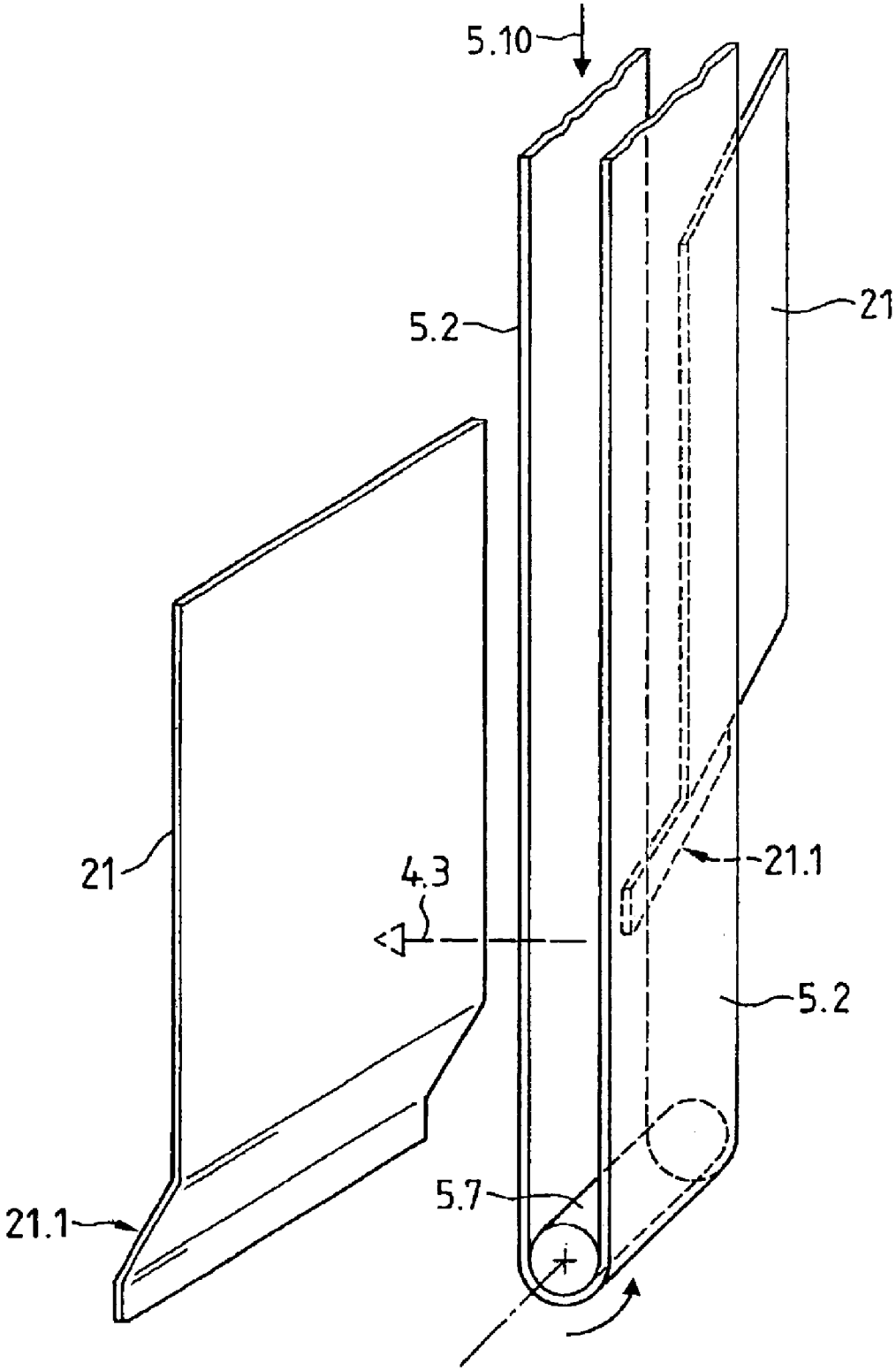
FIG. 10 shows three-dimensionally part of the feed part according to FIG. 9.

FIG. 10 shows three-dimensionally an exemplary embodiment of the guide sheets 21 as described in connection with FIG. 9. The guide sheets 21 comprise protrusions 21.1 protruding forward in stacking direction 4.3. FIG. 10 shows of the feed part the guide sheets 21 and the central outer supply belt 5.2 with its feed side deflection roller 5.7 only. The guide sheets 21 are arranged obliquely relative to the supply belt 5.2, i.e. they take over the articles from the lateral outer supply belts (5.2', FIG. 9) in a bent configuration and guide the articles towards the aligning element in this bent configuration. Such an article which in a part facing away from the aligning element is still held between inner and outer supply belts is then further bent forward in stacking direction 4.3 in a part facing towards the aligning element by the protrusions 21.1 of the guide sheets 21, such pushing away the articles in the loose part of the stack-like arrangement and making room for itself. It shows that the protrusions 21.1 of the guide sheets 21 are arranged advantageously about in the middle between the feed side end of the inner supply belt 5.1 and the aligning element 5.3, as it is shown in FIG. 9.

Figure 11:
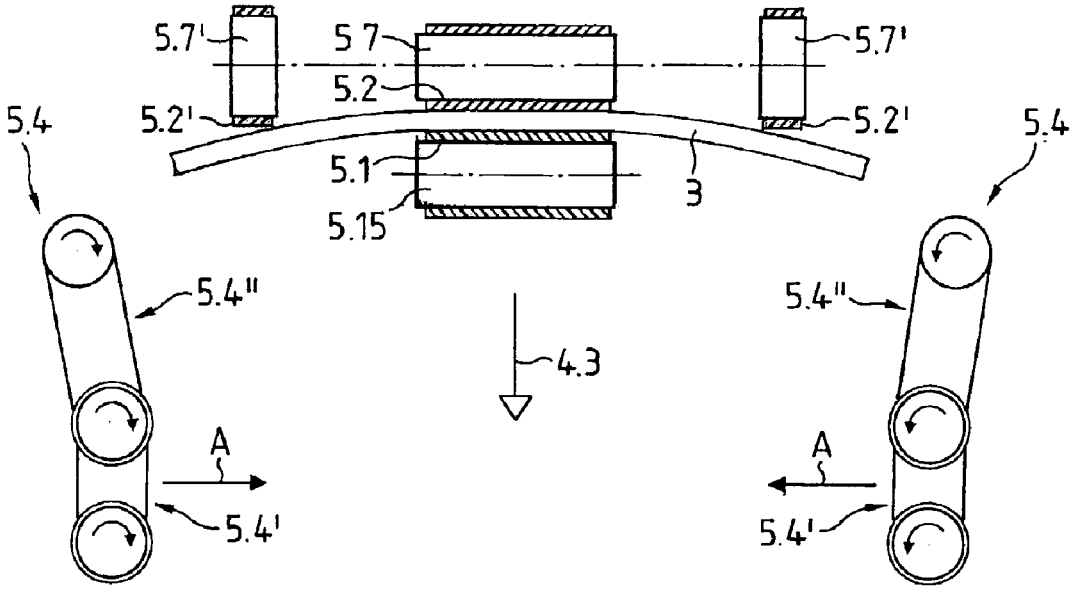
FIGS. 11 to 13 show in a very schematic way exemplary embodiments of the feed part of the device according to the invention.
Figure 12:
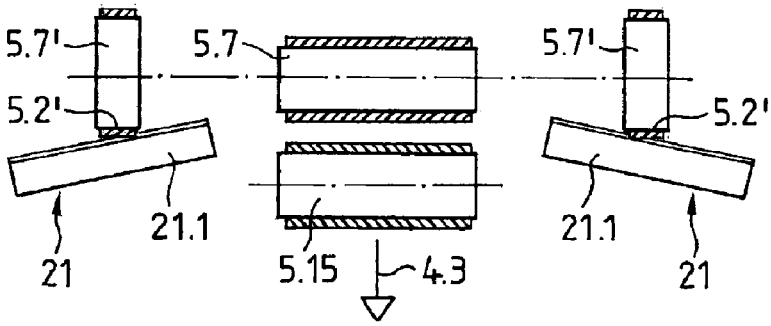
Figure 13:
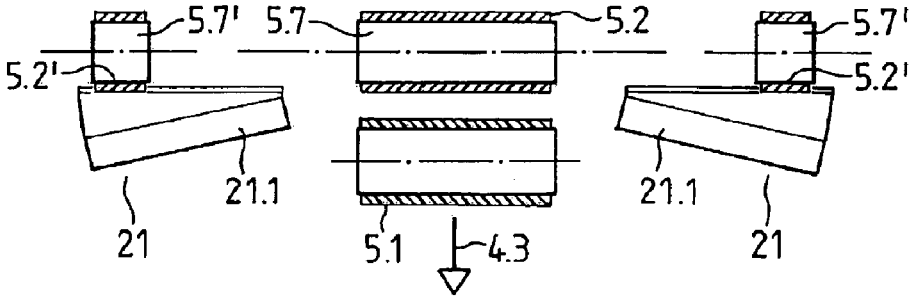

FIGS. 11 to 13 show in a very schematic view parallel to the supply direction and towards the aligning element three embodiments of the feed side region of the feed part of the device according to the invention, in particular the inner and outer supply belts 5.1, 5.2, 5.2' and where applicable the guide sheets 21.

The embodiment according to FIG. 11 is the one as already shown in FIGS. 1 to 8. It comprises an inner supply belt 5.1 with a feed side deflection roller 5.15 as well a central outer supply belt 5.2 with a feed side deflection roller 5.7 and two lateral outer supply belts 5.2' with feed side deflection rollers 5.7'. Deflection rollers 5.7 and 5.7' of the outer supply belts 5.2 and 5.2' are arranged coaxially, the diameter of the deflection rollers 5.7' being larger than the diameter of the deflection roller 5.7, such that a supplied article 3 is bent as shown.

FIG. 11 shows also two opposite condensing means 5.4 acting in an active zone on the articles in the loose part of the stack-like arrangement (not shown). The condensing means according to FIG. 11 differ from the ones shown in FIGS. 1 to 4 by the fact that there function is not only acceleration of the articles for condensing the downstream part of the stack-like arrangement but also lateral alignment of the articles in the loose part of the stack-like arrangement. For the lateral alignment purpose there is an upstream alignment part 5.4" extending upstream of a condensing part 5.4' being distanced from the feed point. The two condensing parts 5.4' extend parallel to the stacking direction 4.3; the two alignment parts 5.4" run in stacking direction towards each other such forming a funnel-like entry into the active zone. In this entry funnel the articles in the loose part of the stack-like arrangement are aligned with each other in a direction perpendicular to the supply direction. Such alignment is possible only in a stack-like arrangement which is as loose as the one produced according to the invention.

For adjusting the device for differing article formats it is advantageous to mount the condensing means such that their position can be changed perpendicular to the stacking direction (arrows A).

FIG. 12 shows in the same way as FIG. 11 the arrangement as shown in FIG. 9. The supplied articles (not shown) are bent around a bending axis parallel to the supply direction by lateral outer supply belts 5.2', are then guided further by guide sheets 21 and are further bent forward in stacking direction by the protrusions 21.1 of the guide sheets 21.

FIG. 13 shows in the same way as FIGS. 11 and 12 a further embodiment of the feed side region of the feed part of a device according to the invention. The deflection rollers 5.7' of the lateral outer supply belts 5.2' have the same diameter as the deflection roller 5.7 of the central outer supply belt 5.2. or they may not be provided at all. The guide sheets 21 which take over guidance of the supplied articles from the lateral outer supply belts 5.2' are twisted in such a manner that they bend the article firstly parallel to the supply direction and then bend a leading part thereof forward in stacking direction 4.3.

In a preferred embodiment of the device according to the invention according to FIG. 1, the feed part 5 comprises a switch point 5.9 for selectively supplying the articles 3 to the aligning element 5.3 either on the left or on the right of the conveyor belt 5.2. On the right-hand side of the aligning element 5.3, a further stacking part 6 for producing stacks 4 may be arranged, or a device for producing bars (stacks as used for intermediate storage containing a considerably larger number of articles and being stabilized by face boards and straps). The switch point 5.9 may serve also as an overflow or for eliminating faulty articles.

What is claimed is:

1. A method for producing stacks from flat articles, the method comprising:

supplying articles in a supply direction to a feed point, the articles overlapping one another and being oriented substantially vertically, at the feed point, pushing leading edges of the supplied articles against an aligning element extending transverse to the supply direction thereby redirecting the articles into a stacking direction substantially at right angles to the supply direction and arranging the articles in a stack-like arrangement, guiding the stack-like arrangement growing in the stacking direction and supporting its downstream end, and separating stacks from the stack-like arrangement, wherein for condensing a downstream part of the stack-like arrangement and for keeping loose a feed-side part to which the articles are supplied, in an active zone distanced in the stacking direction from the feed point, the articles in the stack-like arrangement are accelerated in the stacking direction by being acted on at two opposite edge zones and the articles in at least one of the condensed part and the loose part of the stack-like arrangement are driven in the stacking direction at a speed, which is matched to speed, spacing and thickness of the supplied articles.

2. The method according to claim 1, wherein for separating a stack from the stack-like arrangement, the loose feed-side part is pushed against the condensed downstream part of the stack-like arrangement and both parts together form the stack and are detached.

3. The method in accordance with claim 2, wherein the stack is detached by being rotated away around an axis perpendicular to the stacking direction.

4. The method according claim 2, wherein, during detachment of the stack, a further, loose part is formed by continuously supplying articles.

5. The method in accordance with claim 1, wherein the articles prior to being pushed against the aligning element are bent around a bending axis parallel to the supply direction.

6. The method according to claim 5, wherein the leading parts of the articles being supplied are in addition bent forward in stacking direction before they meet the aligning element.

7. The method according to claim 1, wherein the supply direction extends one of substantially vertically and substantially horizontally; and, the stacking direction extends one of essentially horizontally and slightly sloping downwards.

8. A device for producing stacks of flat articles, the device comprising:

supply means for supplying in a supply direction to a feed point, an imbricated stream of articles overlapping one another and standing upright, an aligning element extending transverse to the supply direction, against which leading edges of the supplied articles are pushed in the feed point for redirecting the articles substantially at right angles into a stacking direction and for arranging the articles in a stack-like manner, a receiving device with means for guiding the stack-like arrangement growing in the stacking direction and with a supporting element for supporting a downstream end of the stack-like arrangement, means for detaching discrete stacks from the stack-like arrangement, and a condensing means located in an active zone distanced in the stacking direction from the feed point, the condensing means being equipped for accelerating in the stacking direction the articles in the stack-like arrangement by acting on two opposite edge zones of the articles and, wherein one of the aligning element is designed as a conveying means and a conveying means parallel to the aligning element is provided, wherein the conveying means is driven in the stacking direction at a speed matched to speed, spacing and thickness of the supplied articles.

9. The device according to claim 8, wherein the condensing means comprises two endless belts driven in opposite directions and being arranged on opposite sides of the stack-like arrangement.

10. The device according to claim 8, wherein the receiving device comprises a conveying means driven in the stacking direction at a speed matched to speed, spacing and thickness of the supplied articles.

11. The device in accordance with claim 10, wherein the supporting element is coupled to the conveying means of the receiving device.

12. The device according to claim 8, wherein, for detaching discrete stacks from the stack-like arrangement, a separating element is provided, the separating element being displaceable in the stacking direction form a position behind the feed point into the active zone and being designed to be driven in such a manner, that during displacement it is capable of splitting-up the supplied fabricated stream and of temporarily taking over the function of the supporting element.

13. The device in accordance with claim 8, wherein, for detaching discrete stacks, at least two receiving devices are provided, the receiving devices being moved coupled together, wherein one of the receiving devices detaches the stack from the stack-like arrangement and another one of the receiving devices is being positioned for receiving the stack-like arrangement.

14. The device according to claim 13, wherein four receiving devices are provided, the receiving devices being arranged roratably around an axis perpendicular to the stacking direction.

15. The device in accordance with claim 8, wherein an inner supply belt and a plurality of outer supply belts are provided for supplying the articles, wherein the inner and at least one of the outer supply belts are elastically pressed against one another.

16. The device according to claim 15, wherein a central, outer supply belt is pressed against the inner supply belt and wherein lateral outer supply bolts are provided, which are arranged in the stacking direction in front of the central, outer supply belt.

17. The device according to claim 15, wherein a feed side deflection roller of the inner supply belt comprises laterally mounted brush rollers rotating with the deflection roller.

18. The device according to claim 15 and further comprising guide sheets for one of replacing feed side ends of the lateral outer supply belts and replacing the lateral outer supply belts, which guide sheets comprise a projection projecting forward in the stacking direction and being positioned between the aligning element and a feed side deflection roller of the inner supply belt.

19. The device according to claim 18, wherein the projections of the guide sheets are positioned in the middle between the aligning element and a feed side deflection roller of the inner supply belt.

20. The device according to claim 18, wherein the guide sheets are one of arranged obliquely relative to the central outer supply belt and twisted.

* * * * *